US011492686B2

(12) United States Patent
Neddemeyer et al.

(10) Patent No.: US 11,492,686 B2
(45) Date of Patent: Nov. 8, 2022

(54) MARTENSITIC STEEL HAVING A Z-PHASE, POWDER AND COMPONENT

(71) Applicant: Siemens Energy Global GmbH & Co. KG, Munich (DE)

(72) Inventors: Torsten Neddemeyer, Falkensee (DE); Torsten-Ulf Kern, Wesel (DE); Karsten Kolk, Mulheim a.d. Ruhr (DE); Axel Bublitz, Berlin (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 192 days.

(21) Appl. No.: 16/639,765

(22) PCT Filed: Aug. 16, 2018

(86) PCT No.: PCT/EP2018/072190

§ 371 (c)(1),
(2) Date: Feb. 18, 2020

(87) PCT Pub. No.: WO2019/052766

PCT Pub. Date: Mar. 21, 2019

(65) Prior Publication Data

US 2020/0208245 A1 Jul. 2, 2020

(30) Foreign Application Priority Data

Sep. 18, 2017 (DE) ..... 10 2017 216 461.1

(51) Int. Cl.

| | |
|---|---|
| ***C22C 38/20*** | (2006.01) |
| ***C22C 38/00*** | (2006.01) |
| ***C22C 38/02*** | (2006.01) |
| ***C22C 38/04*** | (2006.01) |
| ***C21D 8/00*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/32*** | (2006.01) |

(52) U.S. Cl.

CPC ..... *C22C 38/20* (2013.01); *C21D 8/005* (2013.01); *C22C 38/001* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/32* (2013.01); *C21D 2211/008* (2013.01)

(58) Field of Classification Search

CPC ..... C22C 38/02; C22C 38/04; C22C 38/105; C22C 38/12; C22C 38/20; C22C 38/42

See application file for complete search history.

(56) References Cited

U.S. PATENT DOCUMENTS 4,434,006 A 2/1984 Kato et al.

FOREIGN PATENT DOCUMENTS

| | | | |
|---|---|---|---|
| DE | 3018537 | A1 | 11/1980 |
| EP | 1997921 | A2 | 12/2008 |
| EP | 2055797 | A1 | 5/2009 |
| EP | 2479293 | A1 | 7/2012 |
| JP | 2001192781 | A | 7/2001 |
| JP | 2001279391 | A | 10/2001 |
| JP | 2008248385 | A | 10/2008 |
| JP | 2010144204 | A | 7/2010 |

OTHER PUBLICATIONS

English translation of JP2001-279391A from EPO dated Nov. 20, 2021. (Year: 2021).*

Zou Yuqing et al: „汽车材料 (Fahrzeugwerkstoffe); Beijing institute of technology press; Feb. 28, 2015; pp. 1-3; ISBN 978-7-5682-0276-3 / Feb. 28, 2015.

Danielsen H K et al: "Behaviour of Z phase in 9-12%Cr steels", Energy Materials, Maney Publishing, Leeds, GB, vol. 1, No. 1, pp. 49-57, XP002440821, ISSN: 1748-9237, DOI: 10.1179/174892306X99732, abstract, pp. 49, col. 1, pp. 56, col. 2; 2006.

Liu Fang et al: "A new 12% chromium steel strengthened by Z-phase precipitates", Scripta Materialia, vol. 113, pp. 93-96, XP029350515, ISSN: 1359-6462, DOI:10.1016/J.SCRIPTAMAT.2015.10.030, abstract, pp. 1, col. 1; table 1; 2015.

PCT International Search Report and Written Opinion of International Searching Authority dated Sep. 26, 2018 corresponding to PCT International Application No. PCT/EP2018/072190 filed Aug. 16, 2018.

* cited by examiner

*Primary Examiner* — Adam Krupicka

(57) ABSTRACT

An alloy which includes at least the following (in % by weight): carbon (C): 0.15%-0.25%; silicon (Si): 0.0%-0.08%; manganese (Mn): 0.03%-0.20%; chromium (Cr): 9.5%-10.5%; molybdenum (Mo): 0.4%-1.0%; tungsten (W): 1.6%-2.4%; cobalt (Co): 2.5%-3.5%; nickel (Ni): 0.0%-0.40%; boron (B): 0.003%-0.02%; nitrogen (N): 0.0%-0.40%; titanium (Ti): 0.02%-0.10%; vanadium (V): 0.10%-0.30%; niobium (Nb): 0.02%-0.08%; copper (Cu): 1.20%-2.10%; and aluminum (Al): 0.003%-0.06%, in particular 0.005%-0.04%; the remainder being iron (Fe).

18 Claims, No Drawings

MARTENSITIC STEEL HAVING A Z-PHASE, POWDER AND COMPONENT

CROSS REFERENCE TO RELATED APPLICATIONS

This application is the U.S. National Stage of International Application No. PCT/EP2018/072190 filed 16 Aug. 2018, and claims the benefit thereof. The International Application claims the benefit of German Application No. DE 10 2017 216 461.1 filed 18 Sep. 2017. All of the applications are incorporated by reference herein in their entirety.

FIELD OF INVENTION

The invention relates to a martensitic steel comprising Z phase, powder and a component comprising the steel.

BACKGROUND OF INVENTION

In accordance with use conditions, forged rotor disks have hitherto been made of various forging steels. Thus, a steel based on NiCrMoV has been used for compressor disks and a steel based on CrMoWVNbN has been used for turbine disks. The use conditions and the design requirements are decisive for the choice of the forging material.

In the selection of the forging material, it is always necessary to ensure a balance of strength and toughness in order to meet design requirements.

The material having the highest use temperature is at present a steel based on CrMoWVNbN and also a steel based on CrMoCoVB. Both materials are unsuitable in the 800-900 MPa strength class for use above 773 K or 823 K.

For higher use temperatures, nickel materials are at present under discussion. Nevertheless, present-day studies indicate that ferrous alloys can be used at up to 873 K.

Unfortunately, the components have the following disadvantages, for which reason use is advised against: —very high costs compared to a disk made of steel, —new fracture mechanics concepts have to be developed, —longer processing times during manufacture.

SUMMARY OF INVENTION

It is therefore an object of the invention to solve the abovementioned problem.

The problem is solved by an alloy as claimed, a powder as claimed and a component or blank as claimed.

The dependent claims list further advantageous measures which can be combined with one another in any way in order to achieve further advantages.

DETAILED DESCRIPTION OF INVENTION

The alloy composition of martensitic steels has hitherto been restricted by the formation of the Z phase within the time over which the component is utilized.

The alloy of the invention comprises at least (in % by weight):

carbon (C): 0.15%-0.25%,
preferably 0.19%-0.21%,
silicon (Si): 0.0%-0.08%,
preferably 0.0%-0.06%,
manganese (Mn): 0.03%-0.20%,
preferably 0.05%-0.15%,
chromium (Cr): 9.5%-10.5%, preferably 9.8%-10.2%,
molybdenum (Mo): 0.4%-1.0%,
preferably 0.6%-0.8%,
tungsten (W): 1.6%-2.4%,
preferably 1.9%-2.1%,
cobalt (Co): 2.5%-3.5%,
preferably 2.8%-3.2%,
nickel (Ni): 0.0%-0.40%,
preferably 0.0%-0.20%,
boron (B): 0.003%-0.02%,
preferably 0.006%-0.01%,
nitrogen (N): 0.0%-0.40%,
preferably 0.0%-0.20%,
titanium (Ti): 0.02%-0.10%,
preferably 0.04%-0.08%,
vanadium (V): 0.10%-0.30%,
preferably 0.15%-0.25%,
niobium (Nb): 0.02%-0.08%,
preferably 0.04%-0.06%,
copper (Cu): 1.20%-2.10%,
preferably 1.65%-1.85%,
aluminum (Al): 0.003%-0.06%,
in particular 0.005%-0.04%,
balance iron (Fe),
in particular consisting of these elements.

New concepts enable the limit to be shifted: a) shifting of the formation of the Z-phase towards 200 000 hours, b) formation of the Z-phase before commencement of the time over which the later GT forged component is utilized.

As a consequence, the mechanical properties no longer change over the time of utilization as a result of the formation of the Z-phase. Instead, the characteristic values due to the formation of the Z-phase are much more constant. Design of the components is possible.

An advantageous embodiment is (in % by weight):

carbon (C): 0.20%,
silicon (Si): 0.06%,
manganese (Mn): 0.10%,
chromium (Cr): 10%,
molybdenum (Mo): 0.7%,
tungsten (W): 2.0%,
cobalt (Co): 3.0%,
nickel (Ni): 0.0%,
boron (B): 0.010%,
nitrogen (N): 0.0%,
titanium (Ti): 0.05%,
vanadium (V): 0.20%,
niobium (Nb): 0.05%,
copper (Cu): 1.75%,
aluminum (Al): 0.02%,
balance iron (Fe).

Apart from the use as forged disk in a gas turbine, further uses are conceivable, for example gas turbine compressor blades, steam turbine blade or as steam turbine forged part.

The advantages are: —expansion of the use range of "inexpensive" iron-based alloys compared to "expensive nickel-based materials", —faster workability of the rotor components based on iron (9%-11% of Cr) compared to nickel-based materials, —experience from the construction, finishing and production of the high-alloy iron-based alloys can largely be carried over; this helps, for example, in all probabilistic approaches (e.g. fracture mechanics =>minimized risk), —use temperature can be increased and therefore makes power and performance increases for the machine possible without external cooling being necessary.

The invention claimed is:

1. An alloy consisting essentially of (in % by weight):
carbon (C): 0.15%-0.25%,
silicon (Si): 0.0%-0.08%,
manganese (Mn): 0.03%-0.20%,
chromium (Cr): 9.5%-10.5%,
molybdenum (Mo): 0.4%-1.0%,
tungsten (W): 1.6%-2.4%,
cobalt (Co): 2.5%-3.5%,
nickel (Ni): 0.0%-0.40%,
boron (B): 0.003%-0.02%,
nitrogen (N): 0.0%-0.40%,
titanium (Ti): 0.02%-0.10%,
vanadium (V): 0.10%-0.30%,
niobium (Nb): 0.02%-0.08%,
copper (Cu): 1.20%-2.10%,
aluminum (Al): 0.003%-0.06%,
balance iron (Fe),
wherein the alloy is configured as a rotor disk and can withstand temperatures up to 873 K.

2. The alloy as claimed in claim 1 consisting essentially of 0.2% by weight of carbon (C).

3. The alloy as claimed in claim 1 consisting essentially of 0.06% by weight of silicon (Si).

4. The alloy as claimed in claim 1 consisting essentially of 0.1% by weight of manganese (Mn).

5. The alloy as claimed in claim 1 consisting essentially of 10.00% by weight of chromium (Cr).

6. The alloy as claimed in claim 1 consisting essentially of 0.7% by weight of molybdenum (Mo).

7. The alloy as claimed in claim 1 consisting essentially of 2.0% by weight of tungsten (W).

8. The alloy as claimed in claim 1 consisting essentially of 3.0% by weight of cobalt (Co).

9. The alloy as claimed in claim 1 consisting essentially of 0.0% by weight of nickel (Ni) except for contamination level.

10. The alloy as claimed in claim 1 consisting essentially of 0.010% by weight of boron (B).

11. The alloy as claimed in claim 1 consisting essentially of 0.0% by weight of nitrogen (N) except for contamination level.

12. The alloy as claimed in claim 1 consisting essentially of 0.05% by weight of titanium (Ti).

13. The alloy as claimed in claim 1 consisting essentially of 0.20% by weight of vanadium (V).

14. The alloy as claimed in claim 1 consisting essentially of 0.05% by weight of niobium (Nb).

15. The alloy as claimed in claim 1 consisting essentially of 1.75% by weight of copper (Cu).

16. The alloy as claimed in claim 1 consisting essentially of 0.02% by weight of aluminum (Al).

17. An alloy consisting of (in % by weight):
carbon (C): 0.19%-0.21%,
silicon (Si): 0.0%-0.06%,
manganese (Mn): 0.05%-0.15%,
chromium (Cr): 9.8%-10.2%,
molybdenum (Mo): 0.6%-0.8%,
tungsten (W): 1.9%-2.1%,
cobalt (Co): 2.8%-3.2%,
nickel (Ni): 0.0%-0.20%,
boron (B): 0.006%-0.01%,
nitrogen (N): 0.0%-0.20%,
titanium (Ti): 0.04%-0.08%,
vanadium (V): 0.15%-0.25%,
niobium (Nb): 0.04%-0.06%,
copper (Cu): 1.65%-1.85%,
aluminum (Al): 0.005%-0.04%,
Balance iron (Fe),
wherein the alloy is a martensitic steel rotor disk that withstands temperatures up to 873 K.

18. Te An alloy consisting of (in % by weight):
carbon (C): 0.20%,
silicon (Si): 0.06%,
manganese (Mn): 0.10%,
chromium (Cr): 10%,
molybdenum (Mo): 0.7%,
tungsten (W): 2.0%,
cobalt (Co): 3.0%,
nickel (Ni): 0.0%,
boron (B): 0.010%,
nitrogen (N): 0.0%,
titanium (Ti): 0.05%,
vanadium (V): 0.20%,
niobium (Nb): 0.05%,
copper (Cu): 1.75%,
aluminum (Al): 0.02%,
balance iron (Fe),
wherein the alloy is a martensitic steel having a Z phase alloy.

* * * * *